US006779663B1

(12) United States Patent
Pocsi

(10) Patent No.: US 6,779,663 B1
(45) Date of Patent: Aug. 24, 2004

(54) SYSTEM AND METHOD FOR LOADING PILLS INTO A PILLBOX

(76) Inventor: Powell John Pocsi, 2010 Liberty Park Ave., Menlo Park, CA (US) 94025

( * ) Notice: Subject to any disclaimer, the term of this patent is extended or adjusted under 35 U.S.C. 154(b) by 202 days.

(21) Appl. No.: 10/071,800

(22) Filed: Feb. 6, 2002

(51) Int. Cl.[7] ..... B65D 83/04; B65B 1/30; B65B 1/06

(52) U.S. Cl. ..... 206/534; 206/538; 221/2; 222/47; 222/485; 141/242; 141/247

(58) Field of Search ..... 221/2, 86; 414/404; 220/625; 222/47, 48, 485; 141/242, 243, 247; 206/534, 538, 539, 540

(56) References Cited

U.S. PATENT DOCUMENTS

| | | | | |
|---|---|---|---|---|
| 1,717,060 A | | 6/1929 | Mottayaw | |
| 2,004,045 A | | 5/1935 | Weiss | |
| 2,448,918 A | * | 9/1948 | Sessions | 206/539 |
| 3,397,671 A | * | 8/1968 | Hartman, Jr. et al. | 206/532 |
| 3,461,643 A | | 8/1969 | Strand | |
| 3,537,422 A | | 11/1970 | Moe | |
| 3,561,592 A | | 2/1971 | McCool | |
| 3,618,559 A | | 11/1971 | Moe | |
| 3,703,955 A | | 11/1972 | Inacker | |
| 3,744,672 A | | 7/1973 | Dangles et al. | |
| 3,820,655 A | * | 6/1974 | La Tourette et al. | 206/532 |
| 3,911,856 A | | 10/1975 | Ewing | |
| 3,921,806 A | | 11/1975 | Wawracz | |
| 3,926,335 A | | 12/1975 | Dangles et al. | |
| 4,039,080 A | | 8/1977 | Cappuccilli | |
| 4,084,695 A | | 4/1978 | Halbich | |
| 4,204,611 A | | 5/1980 | Graves | |
| 4,258,354 A | | 3/1981 | Carmon et al. | |
| 4,310,103 A | | 1/1982 | Reilly, Jr. et al. | |
| 4,318,477 A | | 3/1982 | Kerpe | |
| 4,403,462 A | | 9/1983 | Halbich | |
| 4,473,156 A | | 9/1984 | Martin | |
| 4,524,869 A | | 6/1985 | Nader | |
| 4,526,474 A | | 7/1985 | Simon | |
| 4,573,580 A | | 3/1986 | Messer | |
| 4,573,606 A | | 3/1986 | Lewis et al. | |
| 4,593,819 A | * | 6/1986 | Will | 206/538 |
| 4,685,271 A | | 8/1987 | Ringer | |
| 4,693,371 A | | 9/1987 | Malpass | |
| 4,749,085 A | | 6/1988 | Denney | |
| 4,763,810 A | | 8/1988 | Christiansen | |
| 4,768,177 A | | 8/1988 | Kehr et al. | |
| 4,771,912 A | * | 9/1988 | van Wingerden | 221/75 |

(List continued on next page.)

*Primary Examiner*—Donald R. Walsh
*Assistant Examiner*—Daniel K Schlak
(74) *Attorney, Agent, or Firm*—Jay P. Hendrickson

(57) ABSTRACT

A pill loader system comprising a pillbox loader and a matching pillbox for loading pills into the pillbox. The pillbox loader has a plurality of loader containers, and the pillbox has an identical number of pillbox containers. The pillbox loader is positioned on top of the pillbox and the pills are placed into the loader containers according to instructions written on a pillbox loader form, which is positioned within a loader bottom plate which is slidably inserted between the loader and pillbox such that the loading instructions appear in the bottom of the loader containers. In operation, the loader bottom plate is removed, and the pills drop into corresponding pillbox containers.

21 Claims, 12 Drawing Sheets

U.S. PATENT DOCUMENTS 4,793,492 A 12/1988 Halbich
4,811,764 A 3/1989 McLaughlin
4,823,982 A 4/1989 Alten et al.
4,837,719 A 6/1989 McIntosh et al.
4,838,453 A 6/1989 Luckstead
4,962,491 A 10/1990 Schaeffer
5,029,726 A 7/1991 Pendill
5,082,113 A 1/1992 Romick
5,088,056 A 2/1992 McIntosh et al.
5,105,949 A 4/1992 Blair
5,143,405 A 9/1992 Daneshvar
5,152,422 A 10/1992 Springer
5,159,581 A 10/1992 Agans
5,174,451 A 12/1992 Niven
5,188,563 A 2/1993 Hanauer
5,221,024 A 6/1993 Campbell
5,321,932 A 6/1994 Sundberg
5,323,907 A * 6/1994 Kalvelage ..... 206/531
D349,850 S * 8/1994 Leman ..... D9/341
5,351,818 A 10/1994 Daneshvar
5,372,276 A 12/1994 Daneshvar
5,377,864 A 1/1995 Blechl et al.
5,401,093 A 3/1995 Resnick
5,408,443 A 4/1995 Weinberger
5,472,113 A 12/1995 Shaw
5,502,944 A 4/1996 Kraft et al.
5,522,525 A 6/1996 McLaughlin et al.
5,558,229 A 9/1996 Halbich
5,562,232 A 10/1996 Pearson
5,564,593 A 10/1996 East, Sr.
5,609,268 A 3/1997 Shaw
5,641,091 A 6/1997 Daneshvar
5,646,912 A 7/1997 Cousin
5,710,551 A 1/1998 Ridgeway
5,752,368 A 5/1998 Tobe
5,765,606 A 6/1998 Takemasa et al.
5,791,478 A * 8/1998 Kalvelage et al. ..... 206/531
5,806,670 A 9/1998 Harlan et al.
5,827,180 A 10/1998 Goodman
5,907,493 A 5/1999 Boyer et al.
5,915,589 A 6/1999 Lim
5,954,225 A 9/1999 Powe
5,954,641 A 9/1999 Kehr et al.
5,971,594 A 10/1999 Sahai et al.
6,000,546 A 12/1999 Noble
6,021,623 A 2/2000 Bouthiette
6,021,902 A 2/2000 Wu
6,021,918 A 2/2000 Dumont et al.
6,026,726 A 2/2000 Bouthiette
6,032,085 A 2/2000 Laurent et al.
6,041,932 A 3/2000 Holmberg
6,068,158 A 5/2000 Chabout
6,102,855 A 8/2000 Kehr et al.
6,119,892 A 9/2000 Laurent et al.
6,457,611 B1 * 10/2002 Koehler ..... 222/462
6,581,356 B2 * 6/2003 Kim ..... 53/154

* cited by examiner

SYSTEM AND METHOD FOR LOADING PILLS INTO A PILLBOX

FIELD OF THE INVENTION

The present invention relates generally to the field of medication pillboxes, and more particularly to a pillbox loader that reduces the likelihood of mistakes, provides ease of use, and is portable.

BACKGROUND OF THE INVENTION

In the ensuing decades, the number of Americans aged sixty-five and older will double to nearly seventy million. The majority of these Americans will, at some time or another, be required to take multiple prescription medications and supplemental vitamins for sustained periods. As these people get older, their ability to timely, efficiently, conveniently, and safely ingest multiple types of multiple doses of medications and vitamins at multiple times will decrease substantially as a result of varying degrees of vision loss, memory loss and physical degeneration. In response to this reality, the use of medication and vitamin pillboxes and dispensers will increase dramatically. Unfortunately, most of these pillboxes and dispensers are inadequate in ensuring that the user can easily and accurately receive the proper medication and/or vitamin.

There are numerous types of medication pillboxes and dispensers, whose aims are to create an easier and more accurate method for organizing and dispensing medications for their users. A common deficiency in the prior art, however, is that the problem of accurately loading pills into a pillbox or dispenser has not been sufficiently addressed. Most pillboxes are designed without recognizing that a pillbox is normally loaded by the patient, without any assistance from a pharmacist, or a competent caregiver. Unfortunately, the probability of pill loading errors increases with the type and number of pills to be loaded and due to the age, and the physical and mental limitations of the patient who is loading the apparatus. If a pillbox or dispenser is incorrectly loaded, then the patient may fail to take the prescribed medicine on time, or may mistakenly ingest an incorrect dosage or a harmful combination of medicines. Naturally, serious and life threatening health consequences may result from such mistakes.

Due to the repetitive and tedious nature of the task involved in loading a pillbox or dispenser, it is difficult to avoid making a mistake. Loading problems and errors may even cause some patients to stop using their pillboxes. One or more of the following problems may cause mistakes to be made in loading pills into pillboxes or dispensers:

Visual Complexity: Too many pills in close proximity can confuse the patient, and pills of similar size, shape and color can add to the confusion.

Haste: Trying to load pills too quickly can cause mistakes.

Infirmities: Infirmities relating to poor vision, memory and coordination usually associated with older patients, may easily lead to mistakes.

Interruptions: A patient's concentration in performing a loading task accurately may be broken by interruptions, causing the patient to lose his or her place in a pill count or proper loading sequence.

These problems in loading pillboxes and dispensers have been partially addressed in the prior art with only limited success. For example, U.S. Pat. Nos. 4,693,371 (1987) to Malpass, U.S. Pat. No. 4,763,810 (1988) to Christiansen and U.S. Pat. No. 5,915,589 (1999) to Lim, describe pillboxes and dispensers that employ both an apparatus and a method which try to ensure the accurate loading of pills. The pillbox described by Malpass employs a series of dual compartments, located either under or besides the compartments to be loaded. A sample dose of each medication is loaded into one compartment of each pair. The sample dose is used as an example to show the user how to load the adjacent compartment. A major disadvantage of this apparatus is that it requires the sacrifice of a portion of each prescription to fill the sample compartments. Prescriptions may not always provide sufficient pills to fill the sample compartments and the cost of extra pills may be substantial. The need to provide sample compartments as well as pill compartments almost doubles the size of the pillbox, making the pillbox less convenient and more expensive to manufacture. The Malpass pillbox is limited to providing only one day of medication, since it allows only one medication type per compartment. Multiple pills in a compartment could overlay and obscure each other. Even if only pills of the same type are used, they could overlay and obscure each other, especially when pill size and quantity are large. The need to reload the pillbox each day increases the probability of making a loading error. It also makes setup and loading more time consuming, when compared to loading done on a weekly basis. Although only one type of medication is used per compartment, it is still relatively easy to accidentally drop pills into adjacent compartments. If these adjacent compartments contain pills of similar size, shape and color, the patient might not notice errors, and the invention does not provide any type of cross-checking method in order to detect any mistakes.

Christiansen proposes two methods for loading his dispenser. The first is the traditional method of loading the pills manually into compartments. No loading aides are provided, so success is dependent entirely on the skill of the loader. All of the deficiencies and problems described above would apply. The second method involves the use of a prepackaged bubble pack. The bubble pack is theoretically available at a pharmacy, either prepackaged by a drug manufacturer or loaded by a pharmacist. Its multiple compartments have a permanently closed top and a slide-open bottom. The pharmacist loads the package manually after first flipping it upside down. Again, no loading aides are provided and all the deficiencies and problems would apply. A patient would not be likely to try to load the bubble pack himself. It would be just as easy to manually load pills directly into the dispenser. Unless the patient is able to find a pharmaceutical company to prepackage his or her medications into the bubble pack, he will have to rely on the skill of a pharmacist, or his or her own skill, to manually load the dispenser. Christiansen uses no method or apparatus for detecting or correcting loading mistakes.

Lim's method of pill loading involves the use of circular color-coded templates that are matched to storage compartments located on a dispenser wheel. Before loading, the patient must apply one or more color-coded labels to each prescription vial. Each label must be marked to indicate the quantity of pills to be loaded into the matching color-coded compartments. The major deficiencies of this technique are: 1) proper color coding of templates and labels, marking of quantities on labels and the application of labels on prescription vials is complex and prone to error; 2) the only way to verify accuracy of the composite pill loading is to check the quantities on each label against the pills in each pill compartment, which is time consuming and also prone to error; 3) changes in number and/or timing of medications are difficult to accomplish; 4) considerable visual complexity can result when using this method, and patients having infirmities are likely to be significantly challenged by setting up and using this loading method; and 5) no adequate method or apparatus for detecting or correcting loading mistakes is provided, and checking color codes and quantities marked on pill vials against pills loaded into compartments can demand too much of the patient's memory to be viable in searching for and correcting mistakes.

The present invention overcomes the significant limitations in the prior art by providing a method and device which substantially improves the accuracy of a pill loading operation and the detection of pill loading mistakes.

SUMMARY OF THE INVENTION

The present invention provides a pill loader system and method comprising a pillbox loader and a pillbox. The pillbox loader contains a latticework pattern of rows and columns of pillbox loader compartments. The rows of loader compartments correspond to the time of day during which a patient's medication is to be taken (e.g., morning, noon, evening, and night or actual times may be entered), and the columns of loader compartments correspond to the days of the week during which a medication should be taken. The pillbox loader also contains a loader bottom plate which is slidably positioned adjacent to a bottom portion of the loader in order to form a loader bottom, and at the same time, form a bottom for each loader compartment. Each loader compartment and its associated bottom form a box-like loader container, with an open top end. All of the loader containers are used to load pills, except for the leftmost column of containers which is used only to display the time of day at which a pill or pills are to be taken. The pillbox loader is also equipped with a hinged loader lid which is attached to the loader and is used to cover the loader when not in use and to hold written loader forms applicable to each medication to be loaded.

A pillbox is also provided which is approximately the same size and shape as the pillbox loader, and the pillbox contains pillbox compartments which form the same latticework and are the same in number, size and shape as the loader compartments. The pillbox also has a pillbox bottom plate which is also slidably positioned adjacent to a bottom portion of the pillbox in order to form a pillbox bottom, and at the same time, form a bottom for each pillbox compartment. Each pillbox compartment and its associated bottom form a box-like pillbox container, with an open top end. As in the pillbox loader, all of the pillbox containers are utilized to hold pills, except for the leftmost column of containers which is used only to display the time of day during which a pill or pills are to be taken. The pillbox is also equipped with a hinged pillbox lid which is attached to the pillbox and is used to cover the pillbox when not in use and to hold composite pillbox forms describing the medications which have been loaded into the pillbox.

In operation, the pillbox lid and the loader lid are both opened and the pillbox loader is mated to the pillbox by positioning the loader on the top of the pillbox such that the loader bottom plate is adjacent to the top of the pillbox and each loader container is aligned with a corresponding pillbox container. The loader bottom plate is temporarily removed from the loader by sliding it out of the bottom of the loader. Once removed, a clear plastic flap, which is attached to one edge of the loader bottom plate and covers the surface of the plate, is lifted or rolled off the plate in order to permit the insertion of a loader form, which is approximately the same size as the loader bottom plate. The loader form depicts a calendar grid of spaces forming a pattern of rows and columns which exactly matches the latticework pattern of rows and columns of the loader containers and, similarly, matches the pattern of rows and columns of pillbox containers. The column of spaces on the leftmost side of the grid forms a time of day calendar column containing time of day indicator spaces which correspond to the time of day during which a patient's medication is to be taken (e.g., morning, noon, evening and night or actual times may be used), and each row of spaces, adjacent to a time of day indicator space, forms a row of dosage indicator spaces which correspond to the days of the week during which a medication should be taken. The loader form is used by a patient or a health care provider in order to illustrate the time of day and the day when a specific pill is to be taken. For example, if the patient is supposed to take one 250 mg calcium pill at noon for one week, the patient or health care provider would complete the loader form corresponding to the calcium medication by marking the time indicator space within the time of day calendar column which correspond to the time of day during which medication is to be taken (e.g., "morn," "noon," "eve," and "nite" or actual times may be used), and then by marking the number "1" in each of seven dosage indicator spaces within the calendar row which corresponds to the time of day indicator space containing the word "noon" in the time of day calendar column.

In a similar manner, the pillbox bottom plate is temporarily removed from the pillbox by sliding it out of the bottom of the pillbox. After it is removed, a clear plastic flap, which is attached to one edge of the pillbox bottom plate and covers the surface of the plate, is lifted or rolled off the plate in order to permit the insertion of the pillbox time form, which is approximately the same size as the pillbox bottom plate. The pillbox time form sets forth a single column of spaces on the leftmost side of the pillbox time form which forms a time of day calendar column containing the time of day indicator spaces which match the identical time of day calendar column of spaces displayed on the loader form. The pillbox time form is used by a patient or a health care provider in order to illustrate the time of day when a pill or pills should be taken. Continuing with the above example, the patient or health care provider completes the pillbox time form by marking each space within the time of day calendar column with the time of day during which medication is to be taken. In the example, "morn," "noon," eve" and "unite" or actual taking times would be written in the four (4) spaces comprising the time of day calendar column, indicating that one or more pills are to be taken at those times during the day.

The pill loading operation is then performed by sliding the loader bottom plate back into the loader so that the loader calendar grid is aligned with the pattern of rows and columns of loader containers. Once the grid is in place, the pill loading display instruction appears within the bottom of the appropriate loader container. Similarly, the pillbox bottom plate is positioned within the pillbox by sliding it back into the bottom portion of the pillbox so that the time of day display appears within the bottom portion of the leftmost column of containers. In the example referred to above, the patient or health care provider places one calcium pill in the bottom of each loader container displaying a "1" since the number "1" indicates that one calcium pill is to be taken on the day and time corresponding to the number's position within the calendar grid. After one calcium pill has been placed within each loader container for the week, the patient or health care provider simply slides the loader bottom plate out of the loader which causes the calcium pills to drop down, under the force of gravity, into corresponding pillbox containers. The pillbox is now loaded with one calcium pill in a one week row of pillbox containers adjacent to and corresponding to the correct time of day (i.e., "noon"), which is displayed within the leftmost container which does not contain a pill.

If additional medication must be taken during the same week, the patient or health care provider repeats the same procedure for each dosage of medication to be taken on specific days and at specific times. The invention requires that a separate loader form, illustrating the correct dosage, be utilized for each medication. If the dosage requires that two or more pills are to be taken at one time, then the number of pills to be taken is depicted on the loader form by placing a number within the appropriate dosage indicator space within the calendar grid which corresponds to the correct number of pills. Thus, in the above example, if two calcium pills were to be taken at noon, the number "2" would appear in each dosage indicator space for the week.

In a preferred embodiment, a bottom portion of each loader form displays a written dosage description which contains, among other things, the name and a picture of the pill to be taken, the number of pills (corresponding to the number written in the calendar grid) to be taken at one time, and on which days and at which times (corresponding to the position within the calendar grid) the pill or pills are to be taken. This dosage description may be used to assist the patient or health care provider in correctly completing the form by placing the correct number within the correct position within the calendar grid. When the loader form is slid into the loader in order to begin loading a specific medication dosage, the written loading instruction appears below and adjacent to the calendar grid. In this manner, the written dosage description can be used by the patient or health care provider as a convenient, visual cross-reference to further ensure that the correct pill and dosage is being placed in the correct loader container.

The present invention substantially improves upon prior art techniques utilized to load medications into a pillbox by providing a method and apparatus which reduces the visual complexity of loading several different pills, to be taken over several days, into a pillbox. Visual complexity is minimized, if not eliminated, by the insertion of the loader form within the loader which acts as a visual aid in guiding the patient or health care provider in placing the pills into the loader, and ultimately into the pillbox. Visual complexity is further reduced by the utilization of one loader form for each medication dosage which causes the patient or health care provider to complete the loading operation of one pill type before starting the loading operation of another pill type. Thus, it is no longer necessary for the person loading the pillbox to keep track by counting and/or visually observing the contents of each pillbox container in order to confirm that the correct number of each type of pill has been placed within each container. Obviously, as the number of pills that must be taken at one time increases, the difficulty of keeping track of which pills have already been loaded into a specific pillbox container also increases. The present invention eliminates the complexity of this task by requiring that the patient or health care provider complete the loading operation of each pill dosage, guided by the visual aid on the loader form, before commencing the loading operation of another pill dosage.

Traditional pillbox loading operations are also prone to errors due to the fact that accuracy is largely dependent upon the ability of the person doing the loading operation to employ a well organized loading procedure and to maintain a high level of awareness and concentration in order to ensure that the medication is loaded correctly. The present invention greatly assists the person performing the loading operation in both areas. A well organized loading procedure is provided by utilizing the loader and its associated loading forms which compels the patient or health care provider to load one mediation at a time and to follow the visual aids displayed by each loader form. Further, the person carrying out the loading does not lose his or her concentration so easily because the loading task has been substantially simplified, requiring less mental energy to avoid making a mistake.

Other advantages of the present invention will become apparent in connection with the more detailed description which follows:

DETAILED DESCRIPTION OF THE INVENTION

Figure 1:
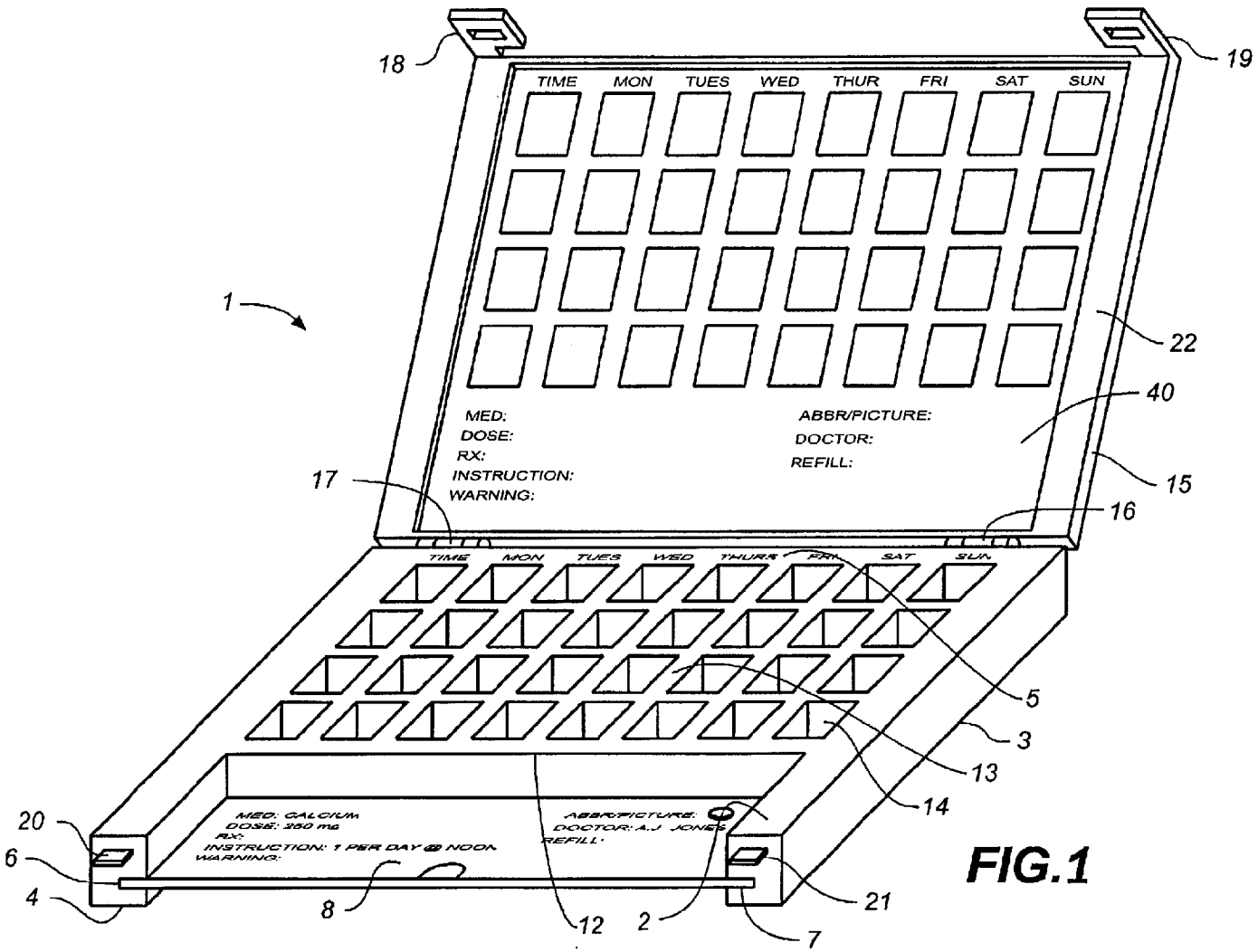
FIG. 1 is a perspective illustration of the pillbox loader with its hinged loader cover open and in a condition to be used to load pills into the pillbox.

FIG. 1 illustrates a perspective view of the pillbox loader 1. The loader 1 includes a rectangularly shaped loader housing 2 which is preferably made of transparent plastic, but may also be made of opaque plastic or other materials. The loader housing 2 consists of a pair of elongated, rectangular, and parallel loader side members 3 and 4, with each loader side member having a front and back end, a top and bottom surface, and an inside surface which faces the inside surface of the opposite loader side member. The housing 2 also includes an elongated, rectangular loader back side member 5, having a top and bottom surface, an inside surface, and the loader back side member 5 is integral with at one end to the back end of one of the loader side members and at the other opposite end is integral with the back end of the other loader side member.

Figure 5:
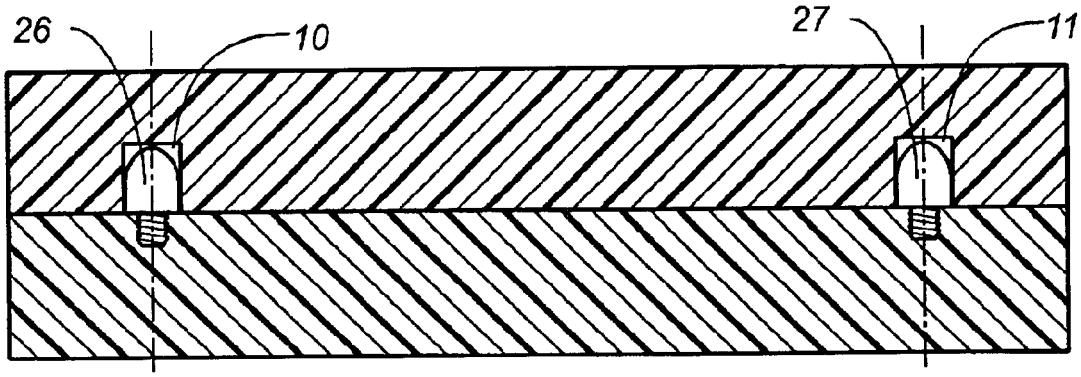
FIG. 5 is a cross section of FIG. 4 along cross section line 5—5 which depicts mated alignment pins and alignment holes.

The inside and facing surface of each loader side member 3 and 4 contains an elongated groove, forming a pair of opposite and parallel grooves 6 and 7, and a loader removable bottom plate 8, having a top surface and a bottom surface, is slidably positioned within the pair of grooves 6 and 7, forming a loader housing bottom. Further, the bottom surface of each loader side member 3 and 4 contains a pair of alignment holes 10 and 11 (shown on FIG. 5) which are used to align and mate the loader 1 to a pillbox, as will be more fully described in connection with FIG.'s 3, 4 and 5. Lastly, the loader housing 2 has an elongated, rectangular loader front end panel 12 which extends between the pair of loader side members 3 and 4, and at one end is integral with the inside surface of one of the side members and at the other end is integral with the opposite inside surface of the other side member.

In a preferred embodiment, a loader latticework 13, also preferably made of transparent plastic, contains seven (7) elongated, rectangularly shaped vertical panels, with each panel having a pair of opposite ends, and contains three (3) similar panels which perpendicularly intersect the seven panels. The latticework 13 is disposed within the space defined by the loader housing's pair of side members 3 and 4, back side member 5, front end panel 12 and bottom plate 8. The adjacent ends of the seven panels are integral with the inside surface of the loader back side member 5 and the opposite adjacent ends are integral with the inside surface of the loader front end panel 12, and in like fashion, the adjacent ends of the three panels are integral with the inside surface of one of the loader side members, and the opposite adjacent ends are integral with the inside surface of the other loader side member. As a result, the loader latticework 13 and its surrounding structure define a latticework pattern comprising four rows of box-like loader containers 14 with eight containers in each row, with each container having a bottom portion and an open top end. Each of the loader containers 14, except for the leftmost column of containers adjacent to loader side member 4, is designed to contain pills that are to be loaded into a pillbox. As will be described in more detail below, the leftmost column of loader containers corresponds to the time of day during which a certain dosage of one or more pills are to be taken, and the seven loader containers in each row correspond to the days of the week, which are permanently labeled along the top surface of the loader's back side member 5.

The pillbox loader 1 further includes a loader cover 15 which is attached along one longitudinal edge to the top surface of the loader back side member 5 by means of a pair of hinges 16 and 17. The loader cover 15 has a rectangular shape which matches the rectangular shape of the housing 2 such that when the cover 15 is rotated downwardly around the hinges 16 and 17, it overlays the loader housing's pair of side members 3 and 4, and back side member 5. A top edge of the cover 15 is fitted with a pair of flexible snap type fasteners 18 and 19, which correspond to a pair of protruding receiving fasteners 20 and 21, which are attached to the front end of each side member 3 and 4. When the loader cover 15 is rotated to a closed position, each fastener can be pressed causing it to mate to its corresponding receiving fastener, which secures the cover 15 in the closed position and also captivates the loader bottom plate 8.

Finally, in a preferred embodiment, the inside surface of the loader cover 15 contains a rectangular loader form holder 22, which is preferably a clear plastic panel which is parallel to and approximately matches the rectangular shape of the loader cover 15. The loader form holder 22 is spaced approximately one fourth of an inch (¼") away from the cover's inside surface, and the form holder's two side edges and bottom edge are attached to the loader cover 15, defining an opening between the holder's top end and the cover 15, and creating a narrow space between the holder 22 and cover 15. As will be more fully described below, the loader's form holder space is used by the present invention to store loader forms to be used to load pills into the pillbox loader. As further shown in FIG. 1, a sample loader form 40, also shown in FIG. 9, has been inserted into the opening formed between the top end of the holder 22 and the loader cover 15 and disposed within the narrow space between the holder 22 and the loader cover 15. In an alternative embodiment, the rectangular form holder can be positioned in a similar fashion on the outside surface of the pillbox loader cover.

Figure 2:
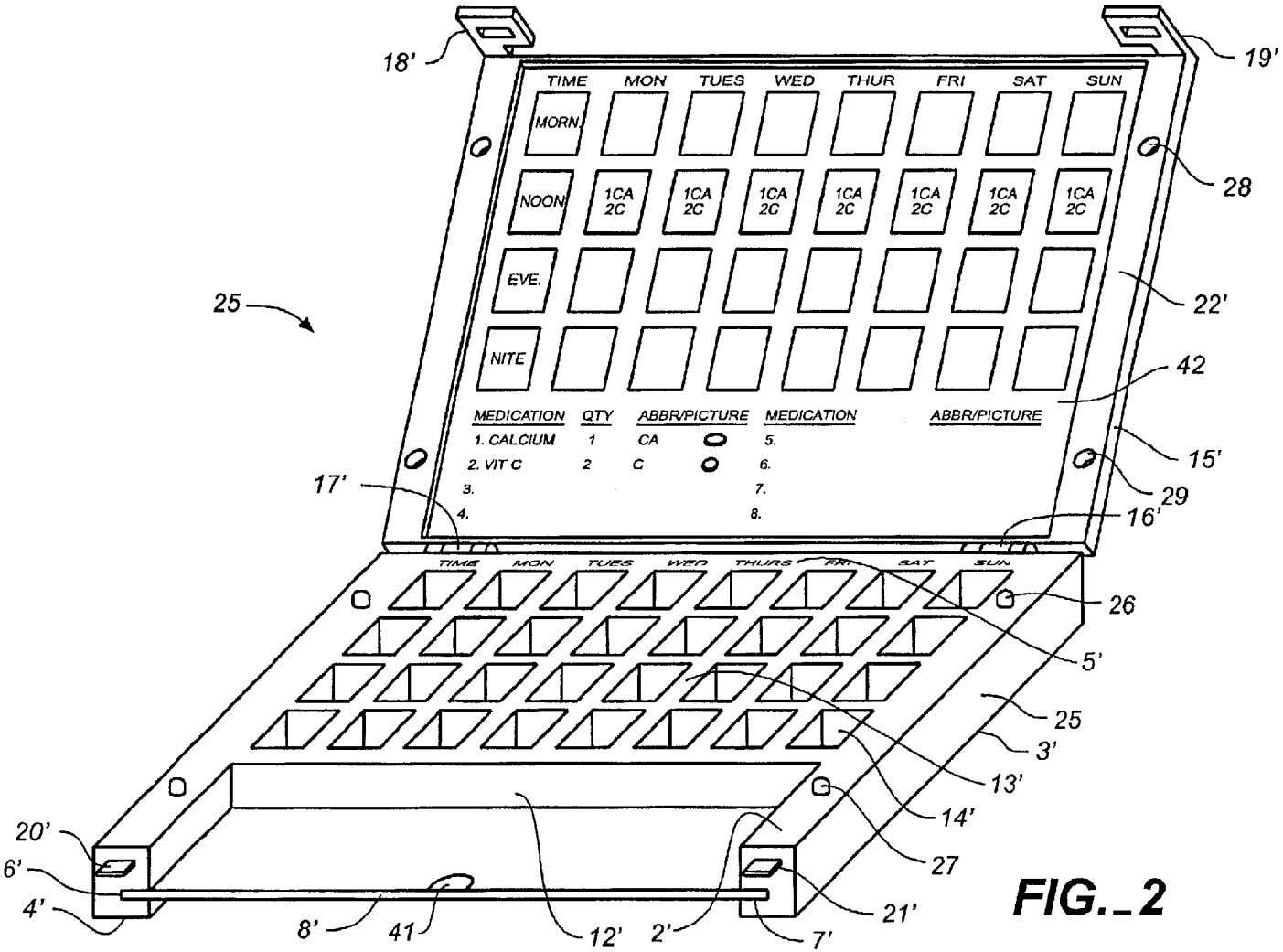
FIG. 2 is a perspective illustration of the pillbox with its hinged pillbox cover open and in a condition to be used to receive pills from the loader.

FIG. 2 illustrates a perspective view of the preferred embodiment of the pillbox 25 to be used in connection with the present invention. As can be seen from the figure, the pillbox 25, with two exceptions noted below, is structurally identical to the pillbox loader 1 in that the pillbox 25 also has a pillbox housing 2' which contains the same component parts as the loader housing 2, including a pair of pillbox side members 3' and 4', pillbox back side member 5', pillbox front end plate 12', removable bottom plate 8', slidably positioned within a pair of grooves 6' and 7' and a pillbox latticework 13' disposed within the pillbox housing 2' forming four (4) rows of box-like pillbox containers 14' with eight (8) containers in each row, and each container having a bottom portion and an open top end. Similar to the time and day markings permanently affixed to the loader 1, the same time and days markings are permanently affixed to the pillbox 25. The pillbox 25 also has a pillbox cover 15' which is identical to the loader cover 15, and the pillbox cover 15' has the same component parts: a pair of hinges 16'and 17', a pair of snap type fasteners 18' and 19', a pair of corresponding receiving fasteners 20' and 21', and a clear plastic form holder 22'. The only structural differences between the pillbox 25 and the loader 1 relate to the structure which, as more specifically described below with regard to FIG.'s 3, 4 and 5, is used to align and mate the loader 1 onto the pillbox 25. The pillbox 25 does not contain a pair of alignment holes within the bottom surface of each of its side members; rather the pillbox 25 contains a pair of alignment pins 26 and 27 which are disposed on the top surface of each side member. The other difference is that the inside surface of pillbox cover contains two pairs of pillbox cover holes 28 and 29, which pass through the plastic form holder 22' and inside surface of the pillbox cover 15'. One pair of pillbox cover holes 28 and 29 located adjacent to an outside edge of the pillbox cover 15' and the other pair of pillbox cover holes 28 and 29 located adjacent to an opposite outside edge. Lastly, FIG. 2 illustrates the utilization of a composite pillbox form 42 which is more specifically described in connection with FIG. 11 below.

Figure 3:
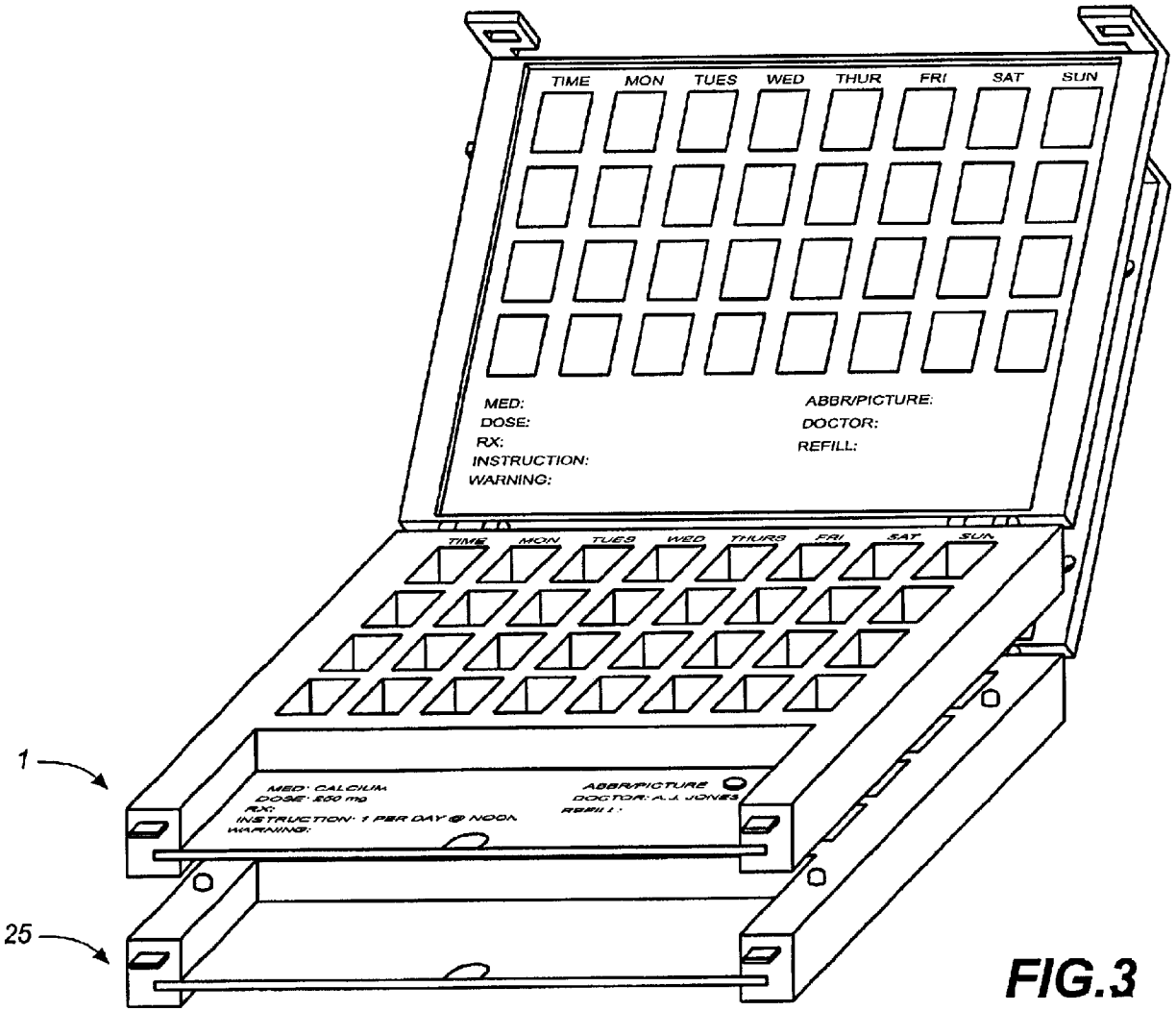
FIG. 3 is a perspective illustration of the manner in which pillbox loader is positioned above the pillbox so that the loader can then be mated to the pillbox.
Figure 4:
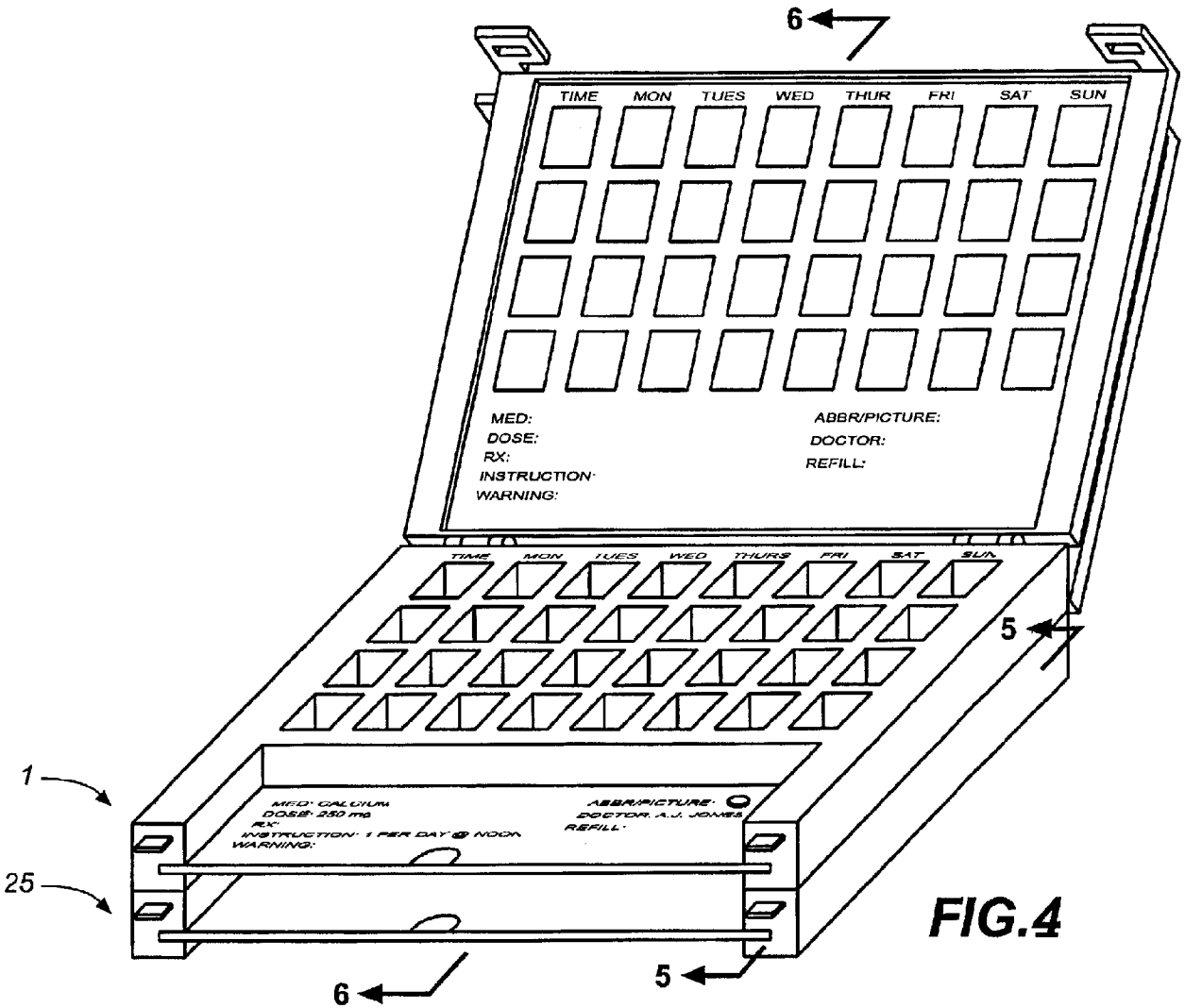
FIG. 4 is a perspective illustration of the pillbox loader which has been mated to the pillbox, also illustrating cross-section line 5—5 and cross section line 6—6.

In operation, as shown in FIG. 3, the loader cover 15 and pillbox cover 15' are both opened and the pillbox loader 1 is positioned above the pillbox 25 such that the pillbox's pair of alignment pins 26 and 27 are aligned with the corresponding pair of alignment holes 10 and 11 (shown in FIG. 5) contained within the bottom surface of the loader 1. And, as shown in FIG. 4, the pillbox loader 1 is mated to the pillbox 25 by disposing the pair of alignment pins 26 and 27 within the corresponding pair of alignment holes 10 and 11 by simply lowering the loader 1 onto the pillbox 25. The alignment and engagement of the pair of alignment pins 26 and 27 and pair of alignment holes 10 and 11 is further illustrated in FIG. 5 which shows a cross sectional view along line 5—5 depicted on FIG. 4.

Figure 6:
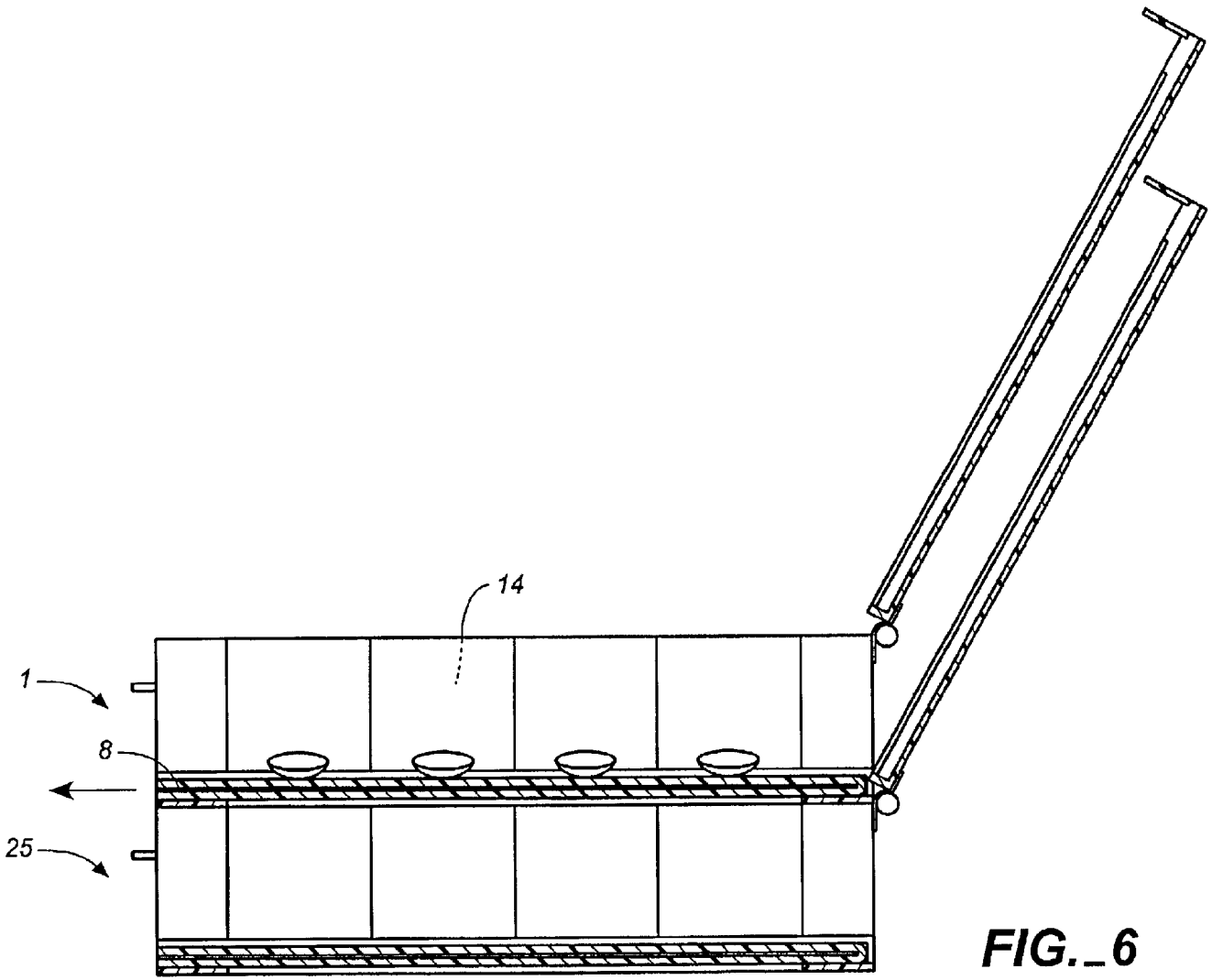
FIG. 6 is an illustration of FIG. 4 along cross-section line 6—6 which depicts pills which have been loaded into the loader.
Figure 7:
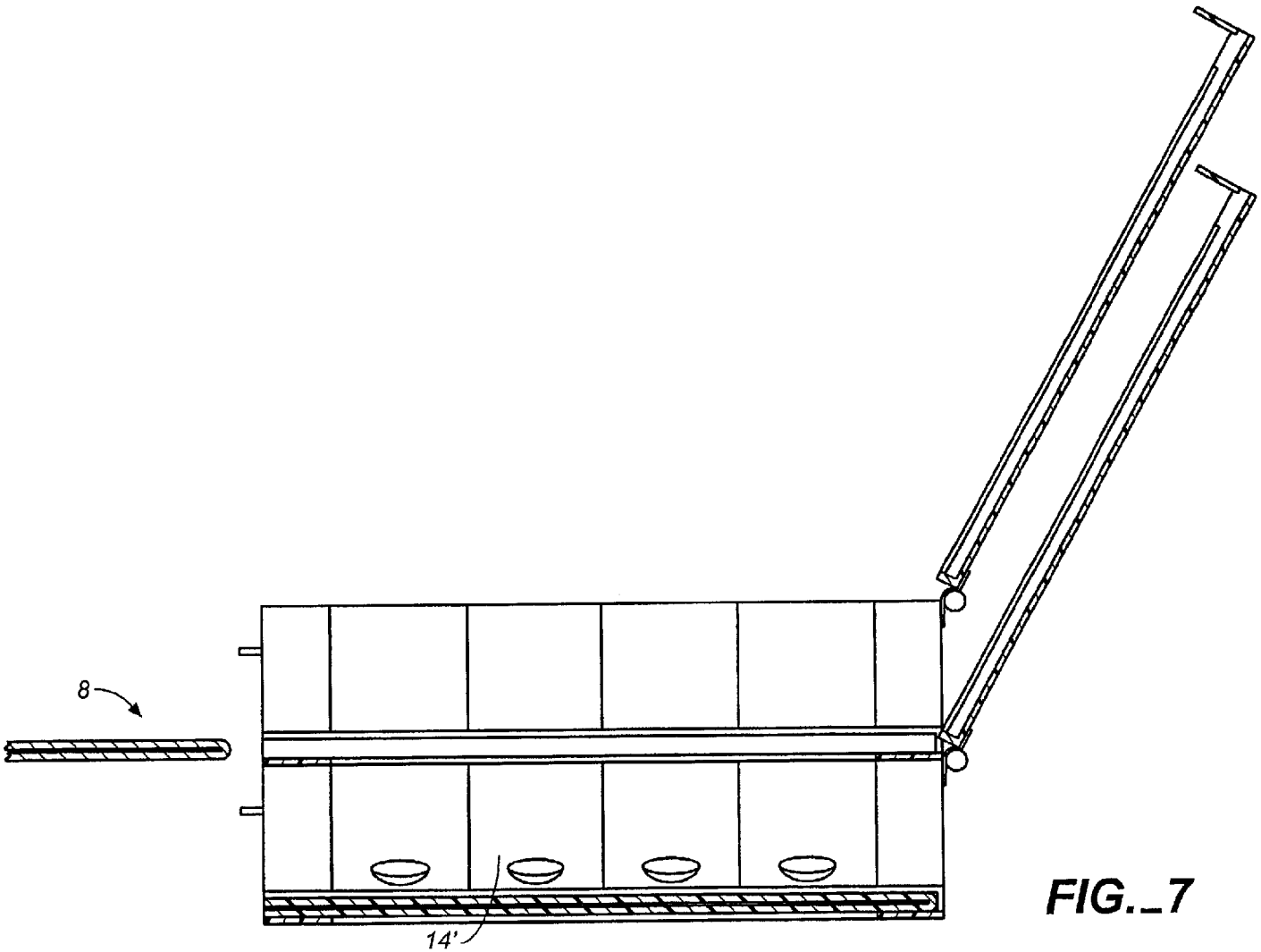
FIG. 7 is an illustration of FIG. 4 in which the loader bottom plate has been removed, causing the pills to drop down into the pillbox.

FIG.'s 6 and 7 illustrate the manner in which the pillbox loader 1 is used to load pills into the pillbox 25. FIG. 6 is a cross-sectional view of the mated pillbox 25 and pillbox loader 1 as shown in FIG. 4, along line 6—6, and further illustrates that one pill has been placed within each of four different loader containers 14, with each pill resting on the top surface of the loader bottom plate 8. FIG. 7 presents the same cross-sectional view as FIG. 6, but illustrates that the pills have dropped down into corresponding pillbox containers 14' when the loader bottom plate 8 is removed. Once the pills are loaded into the pillbox containers, the pillbox loader 1 is lifted off of the pillbox 25, and the pillbox cover 15' may be closed by rotating the pillbox cover 15' in a downward direction around its hinges 16' and 17' until it lies flat against the pillbox 25, with the pair of alignment pins 26 and 27 disposed within the pair of cover holes 28 and 29. The cover 15' secures the pills within the pillbox 25 by mating the pillbox snap type fasteners 18'and 19' to the corresponding receiving fasteners 20' and 21'.

In an alternate embodiment, the pillbox loader 1 and pillbox 25 are constructed such that they are identical and interchangeable. This functionality is accomplished by providing a certain amount of structural redundancy to both the loader and the pillbox. With regard to the pillbox 25, it is further provided with a pair of alignment holes within the bottom surface of each of its side members. The pair of alignment holes are positioned such that each hole is directly below and in axial alignment with one of the corresponding pairs of alignment pins 26 and 27 located on the top surface of the side member. The pillbox loader 1, on the other hand, is provided with a pair of alignment pins, disposed on the top surface of each of its side members. The pair of alignment pins are positioned such that each pin is directly above and in axial alignment with one of the corresponding pairs of alignment holes 10 and 11 located on the bottom surface of the side member. Finally, the pillbox loader cover is provided with alignment holes which are located on the cover's inside surface in the same relative locations as the pairs of alignment holes 28 and 29 located on the inside surface of the pillbox cover. This alternate embodiment substantially reduces the cost of manufacturing because the same mold can be used for fabricating the pillbox and its associated pillbox loader.

Figure 8A:
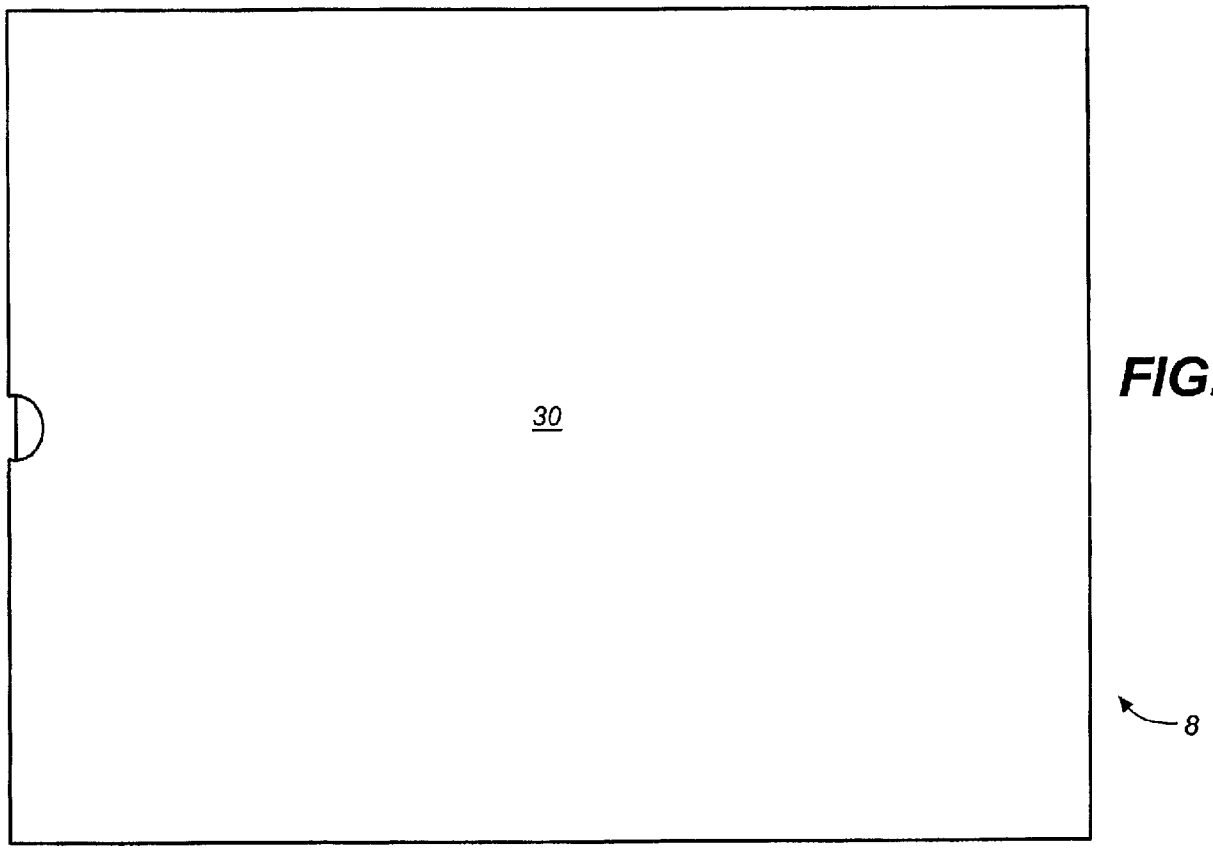
FIG. 8A is a plan view illustration of the loader bottom plate and FIG. 8B is a side view of the loader bottom plate showing the plastic cover flap which has been partially rolled back.
Figure 8B:
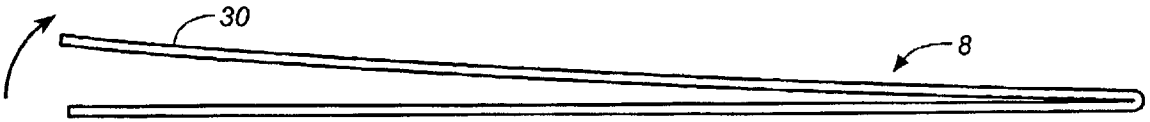

FIG.'s 8A and 8B present a more detailed illustration of the top surface of the pillbox loader bottom plate 8. As shown in the figures, a clear plastic sheet 30 is attached to a back side edge of the bottom plate 8, which permits the plastic sheet 30, as shown in FIG. 8B, to be rolled away from or lifted off of the top surface of the bottom plate 8. When the plastic sheet 30 is completely rolled away from the surface, the loader form 40, shown in FIG. 1 and FIG. 9, may be placed on the top surface of the bottom plate 8, and then held in place by overlaying the plastic sheet 30. This structural description of the pillbox loader bottom plate 8 is equally applicable to the pillbox bottom plate because the two structures are identical. The only non-structural difference relates to the fact that that pillbox bottom plate is used to hold a pillbox time form 41, as shown in FIG. 2 and FIG. 10, rather than a loader form 40.

Figure 9:
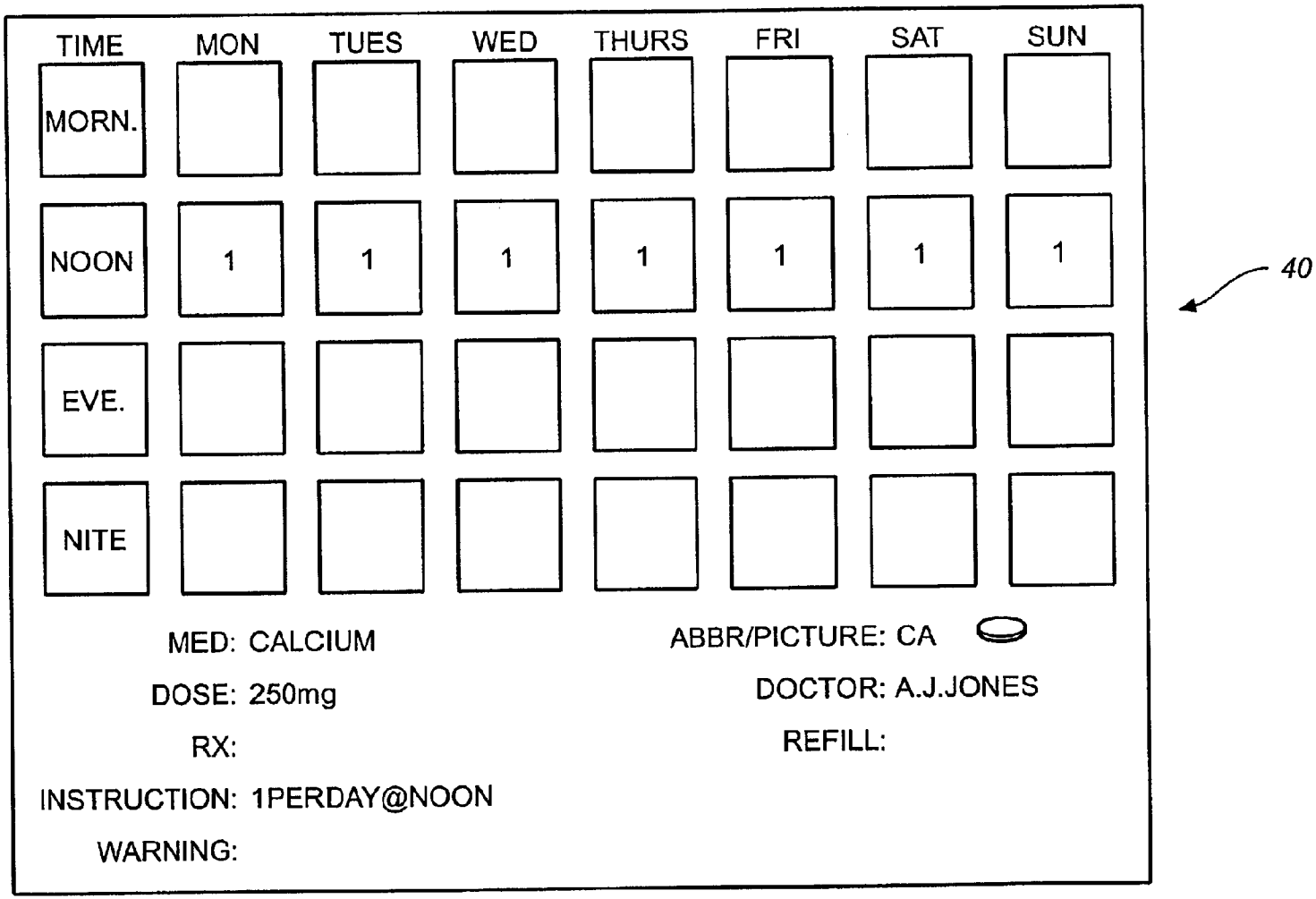
FIG. 9 illustrates the loader form which is used to assist the patient or health care provider in correctly placing pills in the loader.
Figure 10:
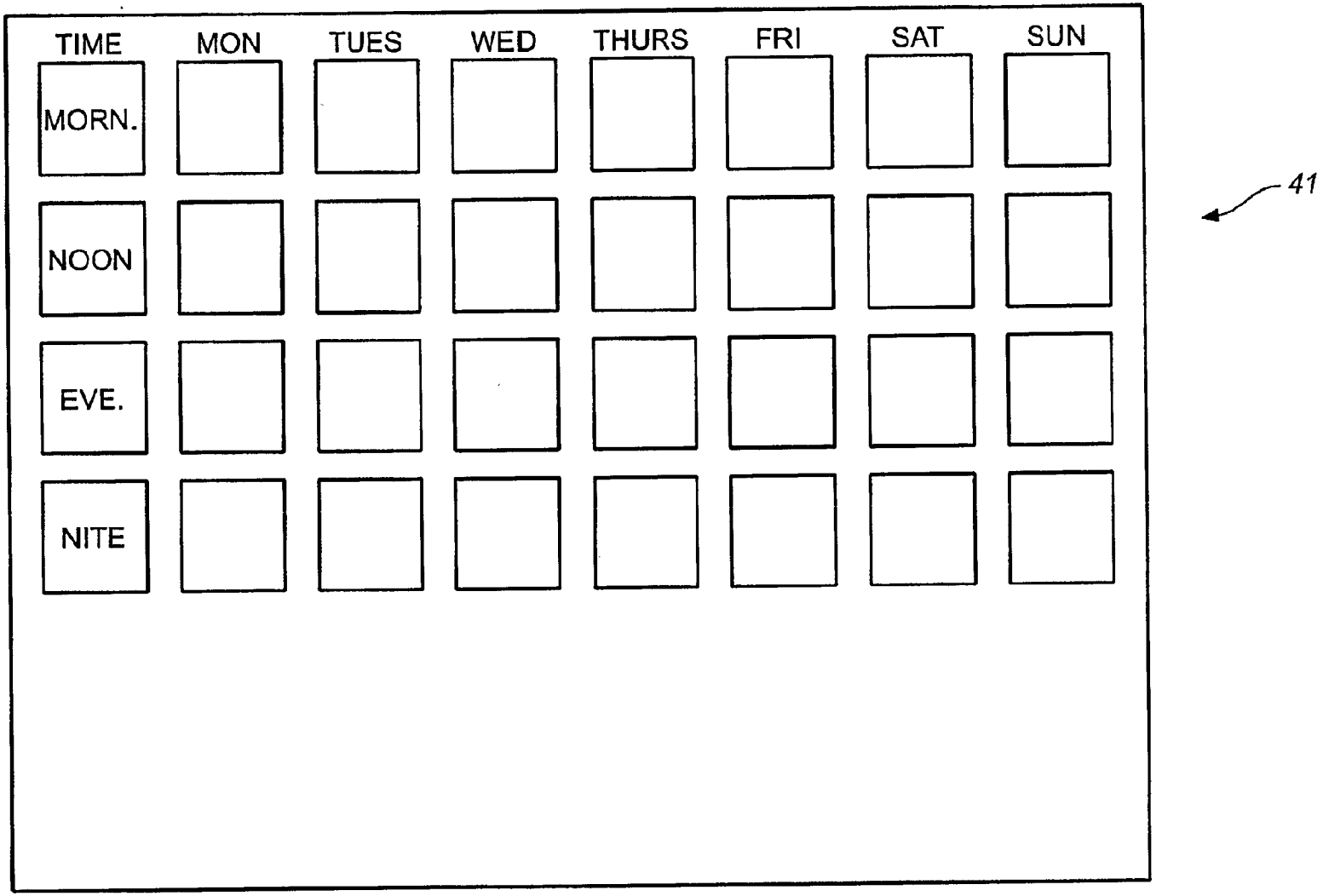
FIG. 10 illustrates the pillbox time form which provides taking times for the medications which have been loaded into the pillbox.

FIG. 9 illustrates an example of the loader form 40 when it is used with the pillbox loader 1 for a typical weekly medication schedule. As shown in the figure, the loader form 40 displays a leftmost column of four (4) time of day indicator spaces and adjacent to each indicator space is a row of seven (7) dosage indicator spaces. The time of day indicator spaces and dosage indicator spaces form a grid or calendar pattern which approximately matches the latticework pattern formed by the pillbox loader's latticework. In the example shown in the figure, the time of day indicator spaces have been filled in to indicate the times during a day (i.e., morning, noon, evening and night) when the medication identified at the bottom of the form (i.e., calcium) is to be taken. The adjacent rows containing the dosage indicator spaces set forth the number of pills that are to be taken during each day of the week. Again, in the example, the physician has prescribed a dosage of 250 mg or one Calcium pill to be taken daily at noon. Accordingly, the patient or health care provider fills out the form by placing a "1" in the row of spaces adjacent to the "noon" space, indicating that one pill should be taken at noon daily. Preferably, the form also contains an actual size picture of the Calcium pill, in order to assist the person loading the loader in making sure that the correct pill is being used.

In operation, the filled out loader form 40 to be used with the pillbox loader 1 is placed face up between the loader bottom plate's top surface and the plastic sheet 30. The loader bottom plate 8 is then inserted into the pair of grooves 6 and 7 within the side members 3 and 4 of the loader 1. If the loader's cover 15 is in its closed position, the cover's snap type fasteners 18 and 19 are loosened from the protruding receiving fasteners 20 and 21, and the cover 15 is rotated into an open position. Once the cover 15 is opened, the loader form's time of day indicator spaces and dosage indicator spaces appear within the bottom portion of a corresponding loader container due to the alignment of the form's grid or calendar pattern with the loader's latticework pattern. The four time of day indicator spaces appear in the leftmost column of loader containers, and the adjacent rows contain the dosage indicator spaces. In the example shown in FIG. 9, the time of day indicators, "morn," "noon," "eve" and "nite" appear in the leftmost column, and the number "1" appears in each dosage indicator space within the row adjacent to the "noon" time space. Thus, the patient or health care provider is directed to load one calcium pill in the loader container corresponding to "noon" on "Mon," "Tues," "Wed," "Thurs," "Fri," "Sat" and "Sun." The loader 1 is then placed on the pillbox 25 as shown in FIG. 4, and the pills are loaded into the pillbox 25 by removing the loader bottom plate 8 from the loader 1, causing the calcium pills, in the example, to drop down into the corresponding pillbox containers within the pillbox 25.

The above described operation is performed for each dosage of medication to be taken during the same week. For example, if the patient is also required to take two Vitamin C pills at noon daily, another loader form would be used for the Vitamin C medication and the number "2" would be written in the dosage spaces adjacent to the "noon" time indicator. The pills are then loaded in the some manner, and the two Vitamin C pills are added to the one Calcium pill already loaded into the pillbox containers for dosages to be taken at noon daily.

Preferably each loader form 40, which has been completed and is to be used to load medication, is stored within the form holder's space located on the inside or outside surface of the pillbox loader. Thus, when the loader cover 15 is opened, the loader forms are in a convenient location and are easily accessible to the patient or health care provider who is loading pills into the loader 1 for loading into the pillbox 25.

In addition to the loader form 40 illustrated in FIG. 9, the present invention also provides, as shown in FIG. 10, a pillbox time form 41. The pillbox time form 41, however, is only used to indicate the times during a given day when certain medications are to be taken. As a result, the pillbox time form 41 is identical to the loader form 40 except that the pill dosage amounts are not filled in. And, the pillbox time form 41 is used with the pillbox bottom plate 8' in the same fashion as the loader form 40 is used with the loader's bottom plate 8, that is by placing the form 41 face up between the bottom plate's top surface and the plastic sheet. After the pillbox's bottom plate is slid into position within the pillbox, the time of day indicators appear within the leftmost column of containers. As a result, after the pills have been loaded into the pillbox 25 by dropping the pills from the pillbox loader containers 14 into the corresponding pillbox containers 14', the time of day indicators, which do not contain any pills, indicate the time of day during which one or more pills within a given pillbox container should be taken.

Figure 11:
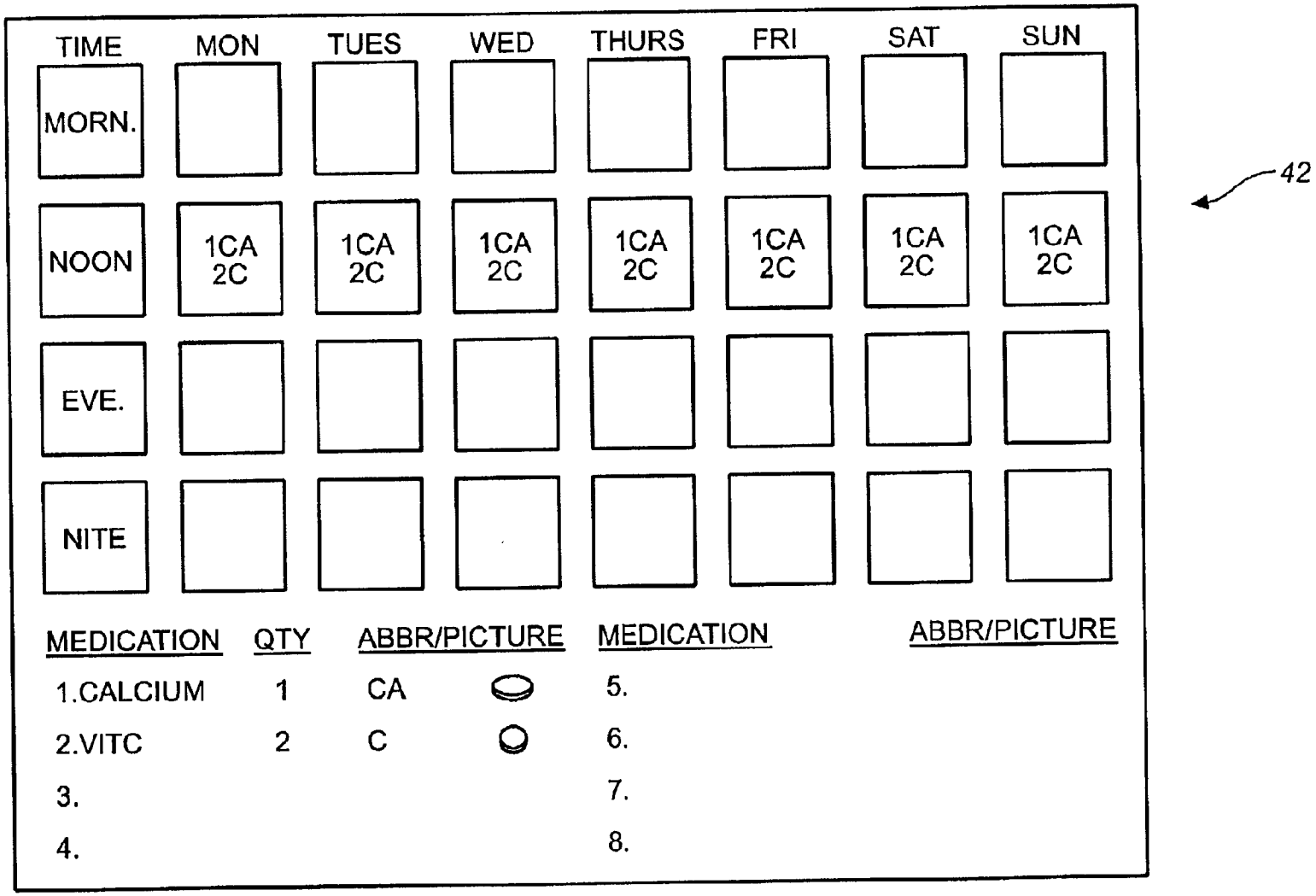
FIG. 11 illustrates the composite pillbox form which shows a composite summary of all the medications which have been loaded into the pillbox.

FIG. 11 is an illustration of the composite pillbox form 42 which may be prepared by the patient, health care provider or pharmacist which summarizes graphically or pictorially all of the medications and dosages to be taken daily for one week. Preferably, as illustrated in FIG. 2, this form is designed to be used with the pillbox 25. The form 42 is placed in the pillbox form holder 22', within the inside surface of the pillbox cover 15', so that when the pill loading operation is completed the pills that have been loaded into the pillbox may be compared to the composite form 42 to ascertain whether any errors have occurred.

Figure 12:
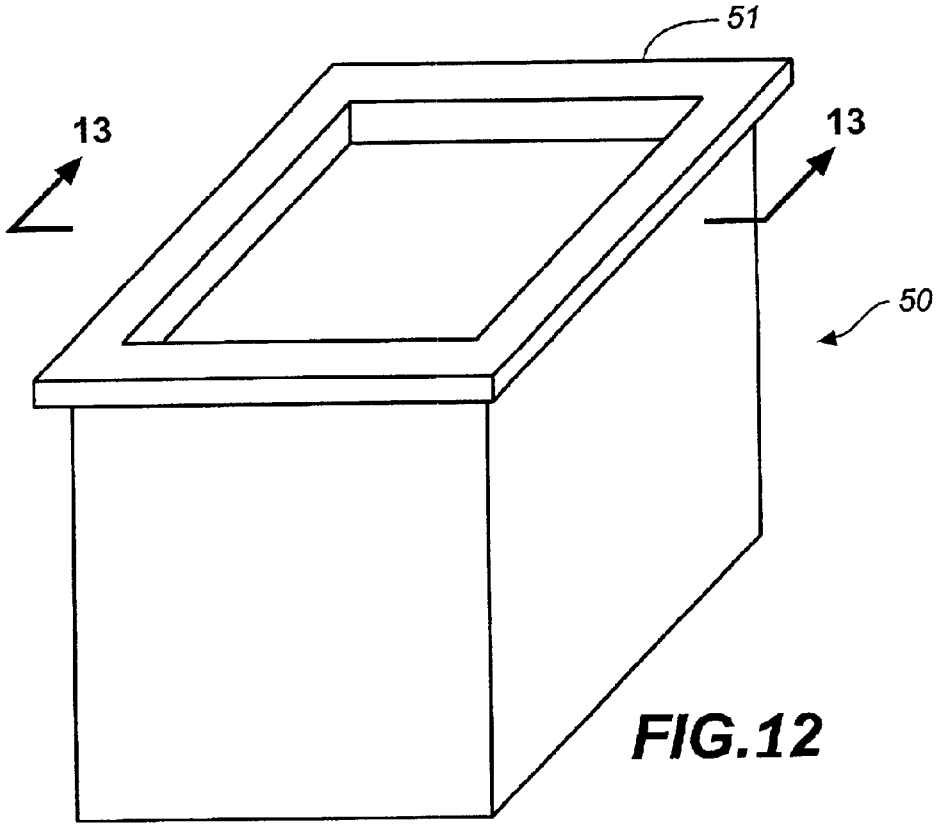
FIG. 12 is a perspective illustration of a pill cup with a snap cap.
Figure 13:
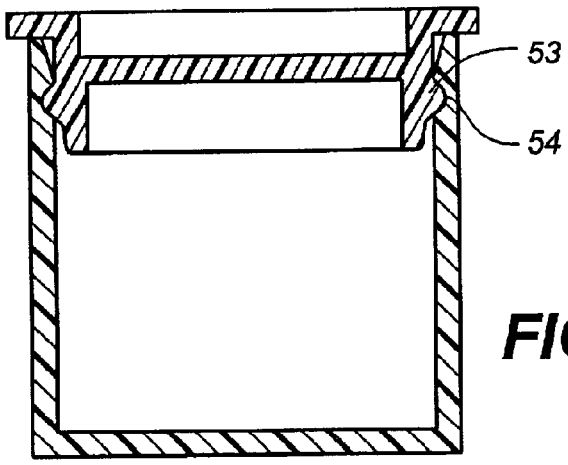
FIG. 13 is a cross-sectional illustration of FIG. 12 along line 13—13 which depicts the mated pill cup and snap cap.

In a preferred embodiment, as shown in FIG. 12, each pillbox container 14' is fitted with an easily removable, box-like pill cup 50. Each pill cup 50 has an open top end, an inside surface, and is dimensioned such that it fits loosely within a corresponding pillbox container 14'. In the loading operation, the pills drop down from the loader 1 and into the pill cups 50 within the pillbox containers 14'. As a result, the patient may more easily remove several pills from the pillbox 25 at one time by simply sliding the pill cup 50, containing the pills, upwardly out of its pillbox container 14'. If the pills within a pill cup 50 are not too numerous, they may be ingested directly from the pill cup, or they may be easily emptied onto a clean surface and taken one at a time. Pills may also be more easily transported to another location by using the pill cup 50. A pill cup lid 51 is used to close the open top end of the pill cup 50 by positioning the lid 51 within the pill cup open top end. The lid 51, as shown in FIG. 13 has a pair of horizontal ridges 53 along opposite outside surfaces of the lid 51 which snap into longitudinal receptor cavities 54 within the inside surface of the pill cup 50. While the present invention has been described with reference to a few embodiments, the description is illustrative of the invention and is not to be construed as limiting the invention. Various modifications may occur to those skilled in the art without departing from the scope of the invention as defined by the appended claims.

What is claimed is:

1. A pill loader system comprising:

a loader, said loader having a loader housing with a removable loader bottom plate having a top and bottom surface, and said loader having a loader latticework, forming a loader latticework pattern, said loader latticework disposed within the loader housing, whereby said loader housing, removable bottom plate, and loader latticework define a plurality of loader containers with each container having a bottom portion and an open top end in order to permit one or more pills to be placed into one or more loader containers;

a loader form positioned on the top surface of the loader bottom plate, said loader form displaying a loader form pattern which matches and is aligned with the loader latticework pattern, and said loader form pattern defining a plurality of dosage indicator spaces which appear in the bottom portion of each loader container, whereby each dosage indicator space may be used to display a number which corresponds to the number of pills to be placed within the corresponding loader container.

2. The pill loader system of claim 1 in which the plurality of pill loader containers form a plurality of rows and columns in which each row corresponds to a different time of the day and each column corresponds to a different day.

3. The pill loader system of claim 1 in which the plurality of pill loader containers form four rows and seven columns in which each row corresponds to a different time of day and each column corresponds to a different day of the week.

4. The pill loader system of claim 3 in which the different time of day corresponds to morning, noon, evening and night.

5. The pill loader system of claim 1 in which the loader form is covered with a flap of clear flexible plastic.

6. The pill loader system of claim 1 in which the loader form displays a representation of least one pill to be loaded into the pill loader container.

7. The pill loader system of claim 1 further comprising a pill loader cover which is pivotally attached to the loader housing, whereby the pill loader cover covers the pill loader housing when the cover is rotated downwardly.

8. The pill loader system of claim 7 in which the pill loader cover has an inside surface, said inside surface having a loader form holder, whereby the holder holds at least one loader form to be used to load pills into the loader.

9. The pill loader system of claim 1 further comprising a pillbox, said pillbox having a pillbox housing and a pillbox latticework, said pillbox latticework forming a pillbox latticework pattern which matches the loader latticework pattern, and said pillbox latticework disposed within the pillbox housing, whereby said pillbox housing and pillbox latticework define a plurality of pillbox containers with each container having an open top end.

10. The pill loader system of claim 9 in which the pillbox is mated to the loader by placing the loader on top of the pillbox such that each loader container aligns with and is directly above a corresponding pillbox container, whereby each pill placed into a loader container will drop into a corresponding pillbox container when the loader bottom plate is removed from the loader.

11. The pill loader system of claim 9 in which the pillbox further comprises a pillbox cover which is pivotally attached to the pillbox, whereby the pillbox cover covers the pillbox housing when the cover is rotated downwardly.

12. The pill loader system of claim 11 in which the pillbox cover has an inside surface, said inside surface having a pillbox form holder, whereby the holder holds at least one pillbox composite form to be used to determine whether the pills were correctly loaded into the pillbox.

13. The pill loader system of claim 9 in which the loader and pillbox are interchangeable.

14. The pill loader system of claim 9 in which at least one removable pill cup is disposed within at least one pillbox container.

15. The pill loader system of claim 9 in which the pillbox is made of plastic.

16. The pill loader system of claim 15 in which the plastic is transparent.

17. The pill loader system of claim 1 in which the pill loader is made of plastic.

18. The pill loader system of claim 17 in which the plastic is transparent.

19. A method of loading pills into a pillbox comprising:

providing a loader, said loader having a loader housing with a removable loader bottom plate, and having a loader latticework, forming a loader latticework pattern, said loader latticework disposed within the loader housing, whereby said loader housing, removable bottom plate and loader latticework define a plurality of loader containers with each container having a bottom portion and an open top end;

providing a loader form, said loader form displaying a loader form pattern which matches the loader latticework pattern, said loader form pattern defining a plurality of dosage indicator spaces;

marking a number within at least one dosage indicator space, whereby said number corresponds to the number of pills corresponding to a single dosage;

placing the loader form on top of the loader's removable bottom plate such that the loader form pattern aligns with the loader latticework pattern;

placing a quantity of at least one pill within the bottom portion of each loader container which displays a number in its bottom portion such that the number matches the quantity of the at least one pill;

providing a pillbox, said pillbox having a pillbox housing and a pillbox latticework, said pillbox latticework having a pattern which matches the loader latticework pattern, and said pillbox latticework disposed within the pillbox housing, whereby said pillbox housing and latticework define a plurality of pillbox containers with each container having an open top end;

placing the loader on top of the pillbox such that each loader container is aligned with and directly above a corresponding pillbox container; and removing the loader's bottom plate, whereby each quantity of at least one pill contained within a loader container drops down into a corresponding pillbox container.

20. The method of claim 19 further comprising:

providing a pillbox cover, said pillbox cover pivotally attached to the pillbox;

removing the loader from the pillbox; and rotating the pillbox cover downwardly in order to cover the top of the pillbox housing.

21. The method of claim 19 further comprising:

providing a pillbox cover, said pillbox cover pivotally attached to the pillbox;

removing the loader from the pillbox;

completing a composite pillbox form which summarizes all of the pills that should have been loaded into the pillbox; and inserting the composite pillbox form into a pillbox form holder disposed on inside surface of the pillbox cover.

* * * * *